US010315886B2

(12) United States Patent
Hu

(10) Patent No.: US 10,315,886 B2
(45) Date of Patent: Jun. 11, 2019

(54) ELECTRONIC SAFETY ACTUATION DEVICE WITH A POWER ASSEMBLY, MAGNETIC BRAKE AND ELECTROMAGNETIC COMPONENT

(71) Applicant: Otis Elevator Company, Farmington, CT (US)

(72) Inventor: Guohong Hu, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 491 days.

(21) Appl. No.: 15/095,617

(22) Filed: Apr. 11, 2016

(65) Prior Publication Data

US 2017/0291798 A1 Oct. 12, 2017

(51) Int. Cl.

| | |
|---|---|
| ***B66B 1/06*** | (2006.01) |
| ***B66B 5/16*** | (2006.01) |
| ***B66B 1/32*** | (2006.01) |
| ***B66B 9/00*** | (2006.01) |
| ***B66B 5/22*** | (2006.01) |

(52) U.S. Cl.

CPC ..... *B66B 5/16* (2013.01); *B66B 1/32* (2013.01); *B66B 5/22* (2013.01); *B66B 9/00* (2013.01)

(58) Field of Classification Search

CPC .... B66B 5/16; B66B 1/32; B66B 9/00; B66B 5/22

USPC ..... 187/247, 277, 289, 290, 391, 393, 288; 307/66, 68

See application file for complete search history.

(56) References Cited

U.S. PATENT DOCUMENTS

| | | | | |
|---|---|---|---|---|
| 4,453,114 | A | 6/1984 | Norlund | |
| 5,276,292 | A | 1/1994 | Goto et al. | |
| 5,341,902 | A * | 8/1994 | Ruiz, Sr. | B66B 5/027 187/251 |
| 5,732,795 | A * | 3/1998 | McCarthy | B66B 1/34 187/250 |
| 6,516,922 | B2 | 2/2003 | Shadkin et al. | |
| 6,626,267 | B2 * | 9/2003 | Beus | B66B 1/34 187/290 |
| 7,104,363 | B2 * | 9/2006 | Mori | B66B 1/30 187/290 |
| 7,275,622 | B2 | 10/2007 | Hall et al. | |
| 7,896,137 | B2 * | 3/2011 | Ishikawa | B66B 11/005 187/290 |
| 8,164,283 | B2 | 4/2012 | Sheahan, Jr. et al. | |
| 8,220,590 | B2 | 7/2012 | Chen et al. | |
| 8,356,698 | B2 * | 1/2013 | Zepke | B66B 1/468 187/290 |

(Continued)

FOREIGN PATENT DOCUMENTS

| | | |
|---|---|---|
| CN | 102459050 B | 11/2014 |
| JP | 2008254837 A | 10/2008 |
| WO | 2012080106 A2 | 6/2012 |

OTHER PUBLICATIONS

European Search Report for application EP 17165916.2, dated Aug. 30, 2017, 9 pages.

*Primary Examiner* — Anthony J Salata

(74) *Attorney, Agent, or Firm* — Cantor Colburn LLP

(57) ABSTRACT

An elevator system including a hoistway, an elevator component disposed in the hoistway, a power generating device disposed within the hoistway and operably coupled to the elevator component, wherein the power generating device is configured to generate power when the elevator component is in motion.

13 Claims, 5 Drawing Sheets

(56) References Cited

U.S. PATENT DOCUMENTS

| | | | | |
|---|---|---|---|---|
| 8,413,765 | B2 | 4/2013 | Stratmann | |
| 8,668,055 | B2 | 3/2014 | Spirgi | |
| 8,820,482 | B2 | 9/2014 | De Coi et al. | |
| 8,827,044 | B2 | 9/2014 | Marvin et al. | |
| 9,136,749 | B1 * | 9/2015 | Callier | H02K 35/02 |
| 9,309,091 | B2 * | 4/2016 | Husmann | B66B 5/12 |
| 9,834,406 | B2 * | 12/2017 | Mezzadri | B66B 1/306 |
| 9,850,095 | B2 * | 12/2017 | Moon | B66B 9/00 |
| 2003/0000778 | A1 * | 1/2003 | Smith | B66B 1/30 187/289 |
| 2006/0108867 | A1 | 5/2006 | Ralea | |
| 2013/0146399 | A1 | 6/2013 | De Coi et al. | |
| 2015/0203328 | A1 * | 7/2015 | Horbrugger | B66B 1/302 187/290 |
| 2016/0348387 | A1 * | 12/2016 | Geiger | E04B 1/34807 |

* cited by examiner

ELECTRONIC SAFETY ACTUATION DEVICE WITH A POWER ASSEMBLY, MAGNETIC BRAKE AND ELECTROMAGNETIC COMPONENT

TECHNICAL FIELD OF THE DISCLOSED EMBODIMENTS

The present disclosure is generally related to braking and/or safety systems for elevator systems and, more specifically, an electronic safety actuation device with a power assembly.

BACKGROUND OF THE DISCLOSED EMBODIMENTS

Some machines, such as an elevator system, include a safety system to stop the machine when it rotates at excessive speeds or the elevator cab travels at excessive speeds or accelerations. Conventional safety systems include an actively applied safety system that requires power from travelling cables to positively actuate the safety mechanism or a passively applied safety system that requires power from travelling cables to maintain the safety system in a hold operating state. There is a need for a safety system with reduced complexity without the need for additional travelling cables or additional power wires to the elevator car and/or counterweight.

SUMMARY OF THE DISCLOSED EMBODIMENTS

In one aspect, an elevator system is provided. The elevator system includes a hoistway, an elevator component disposed in the hoistway, and a power generating device disposed within the hoistway and operably coupled to the elevator component, wherein the power generating device is configured to generate power when the elevator component is in motion. In an embodiment, the elevator component includes at least one of an elevator car and a counterweight. In an embodiment, the power generating device includes a wind turbine.

In an embodiment, the elevator system further includes a safety actuation device operably coupled to the elevator component, and a power assembly disposed within the safety actuation device and operably coupled to the power generating device. In an embodiment, the power assembly includes at least one power storage device operably coupled to the power generating device, and a safety actuation device controller operably coupled to the at least one power storage device, the safety actuation device controller configured to receive and transmit safety signals.

In one embodiment, the safety actuation device includes a roller guide affixed thereto. In this embodiment, the power generating device is disposed adjacent to and in contact with the roller guide.

In one embodiment, elevator system further includes a guide rail disposed in the hoistway; the guide rail configured to engage the elevator component and direct the course of travel of the elevator component, and a safety device operably coupled to the elevator component and safety actuation device, the safety device configured to engage the guide rail.

In one embodiment, elevator system further includes an elevator drive operably coupled to the elevator component and in communication with the safety actuation device controller to receive and transmit the safety signals. In this embodiment, the safety actuation device controller is configured to wirelessly exchange safety signals with the elevator drive.

In one aspect, a safety actuation assembly is provided. The safety actuation assembly includes a housing, a power assembly disposed within the housing, an electromagnetic component operably coupled to the housing, the electromagnetic component operably coupled to the power assembly, wherein the electromagnetic component is configured generate an actuation or reset, and a power generating device operably coupled to the power assembly, the power generating device configured to transfer power to the power assembly based in part on movement of the power generating device.

In an embodiment, the power assembly includes at least one power storage device operably coupled to the power generating device, and a safety actuation device controller operably coupled to the at least one power storage device, the safety actuation device controller configured to receive and transmit safety signals.

In an embodiment, the safety actuation assembly further includes a magnetic brake disposed adjacent to the electromagnetic component, the magnetic brake configured to move between an engaging position and a non-engaging position based in part on a holding force. In an embodiment, the safety controller includes a communication module. In an embodiment, the communication module is configured to wirelessly receive and transmit safety signals.

In an embodiment, the power generating device includes a wind turbine. In one embodiment, the safety actuation assembly further includes a roller guide affixed to the housing. In this embodiment, the power generating device is disposed adjacent to and in contact with the roller guide.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
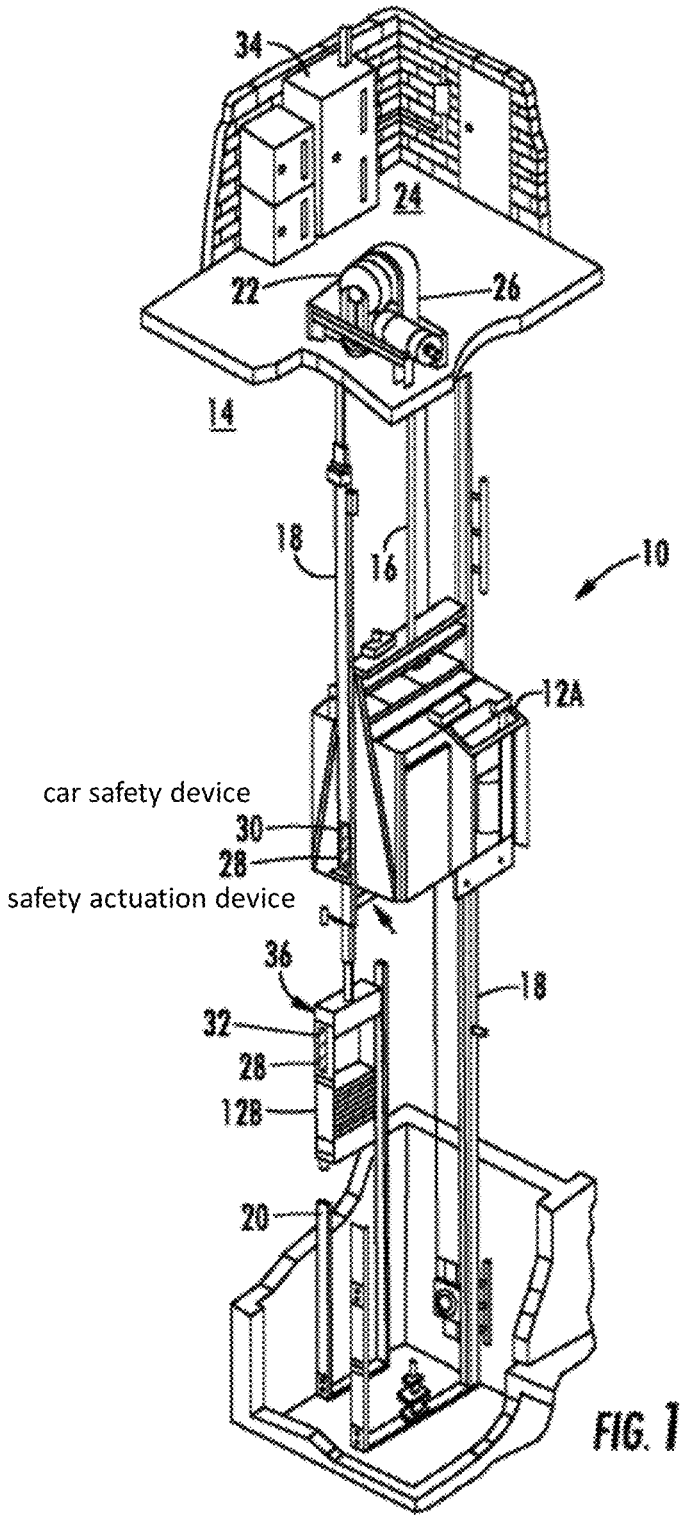
FIG. 1 is a schematic diagram of an elevator system employing an electronic safety actuation device to the elevator car and/or counterweight.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 shows an embodiment of an elevator system, generally indicated at 10. The elevator system 10 includes an elevator component 12A-B disposed in a hoistway 14. In an embodiment, the elevator component 12A-B includes at least one of an elevator car 12A and a counterweight 12B. The elevator car 12A is suspended by a cable 16 in the hoistway 14. The elevator car 12A is guided between car guide rails 18. The counterweight 12B is guided between counterweight guide rails 20 and is suspended on an opposite end of the cable 16.

Movement of the elevator car 12A and counterweight 12B in the hoistway 14 is provided by a motor 22 mounted in a machine room 24. The motor 22 rotates a sheave 26 around which the cable 16 extends to raise and lower the elevator car 12A and counterweight 12B.

An electromechanical brake (not shown) located in the machine room 24, electronic safety actuation devices 28 operably coupled to car safeties 30, and/or counterweight safeties 32 act to stop elevator car 12A and counterweight 12B if the elevator car 12A or counterweight 12B exceeds a set speed as they travel inside the hoistway 14. If the elevator car 12A or counterweight 12B reaches a defined over-speed condition, the electronic safety actuation device 28 detects this event, and transmits a signal to an elevator drive 34 (shown in the machine room 24 in this embodiment), which in turn cuts power to the elevator drive 34 and drops the machine brake to arrest movement of the sheave 26 and thereby arrest movement of elevator car 12A and counterweight 12B.

If, however, cables 16 break, the elevator car 12A otherwise experiences a free-fall condition unaffected by the machine brake, the machine brake fails to arrest movement of the sheave 26, or the over-speed condition worsens, the electronic safety actuation device 28 may then act to actuate either or both of the car safety device 30 and/or counterweight safety device 32 to arrest movement of the elevator car 12A and/or the counterweight 12B.

Figure 2:
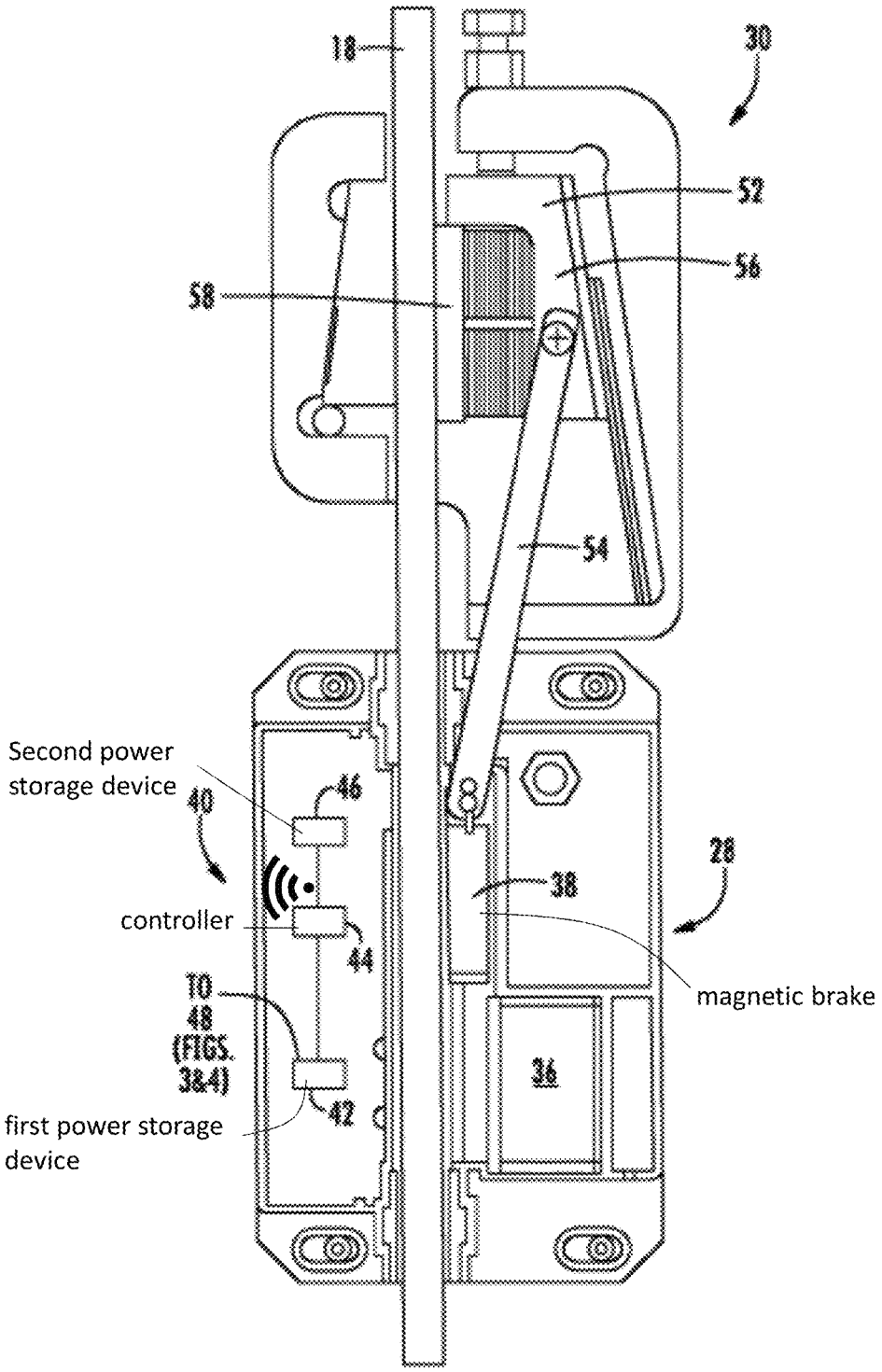
FIG. 2 is a schematic cross-sectional view of an electronic safety actuation device, with a power assembly in use without a power traveling cable, in an engaging position according to an embodiment of the present disclosure.

FIG. 2 shows an embodiment of an exemplary electronic safety actuation device 28 operably coupled to a car safety device 30, the car safety device 30 in an engaging position against the car guide rail 18. It will be appreciated that the exemplary electronic safety actuation device 28 may also actuate a counterweight safety device 32 to the counterweight guide rail 20 in a similar manner, and may include similar components as described below.

The electronic safety actuation device 28 includes an electromagnetic component 36 and a magnetic brake 38. In one embodiment, in order to power the electromagnetic component 36, a portion of a power assembly 40 is disposed within the safety actuation device 28. The other portion of the power assembly 40 is operably coupled to at least one of elevator car 12A and counterweight 12B (shown in FIGS. 3 and 4) depending on whether the safety actuation device 28 is operably coupled to elevator car 12A and/or counterweight 12B.

As shown in FIG. 2, the power assembly 40 includes a first power storage device 42, for example a battery to name one non-limiting example, operably coupled to an electronic safety actuation device controller 44. The electronic safety actuation device controller 44 is further coupled to a second power storage device 46. The second power storage device 46, for example a capacitor to name one non-limiting example, is further coupled to a portion of the electronic safety actuation device (e.g., the electromagnetic component 36), and is configured to activate the safety actuation device 28 based in part on an actuation command.

The electronic safety actuation device controller 44 is in communication with the elevator drive 34 via a communication module (not shown) disposed on the electronic safety actuation device controller 44. In an embodiment, the communication module is configured to wirelessly exchange safety signals with the elevator drive 34. It will be appreciated that the communication module may be separate from the electronic safety actuation controller 44.

Figure 3:
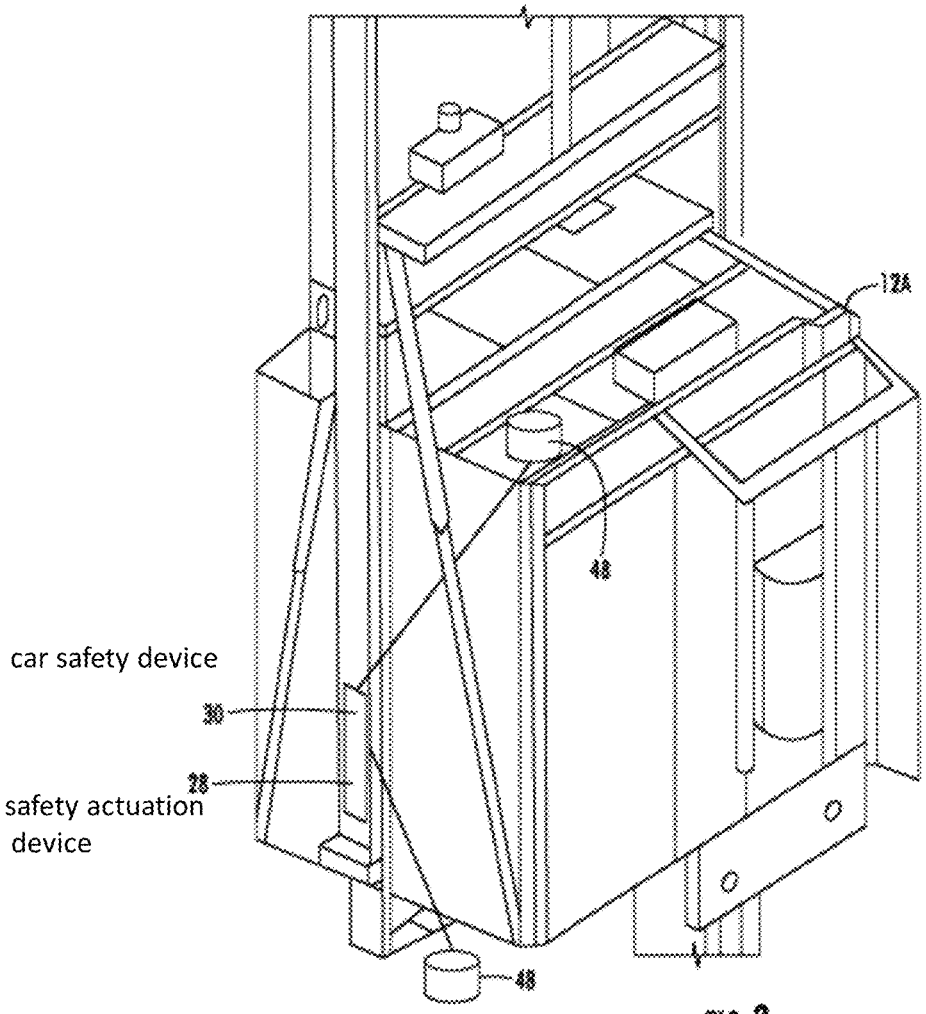
FIG. 3 is a perspective view of an electronic safety actuation device with a power assembly in use with an elevator car.
Figure 4:
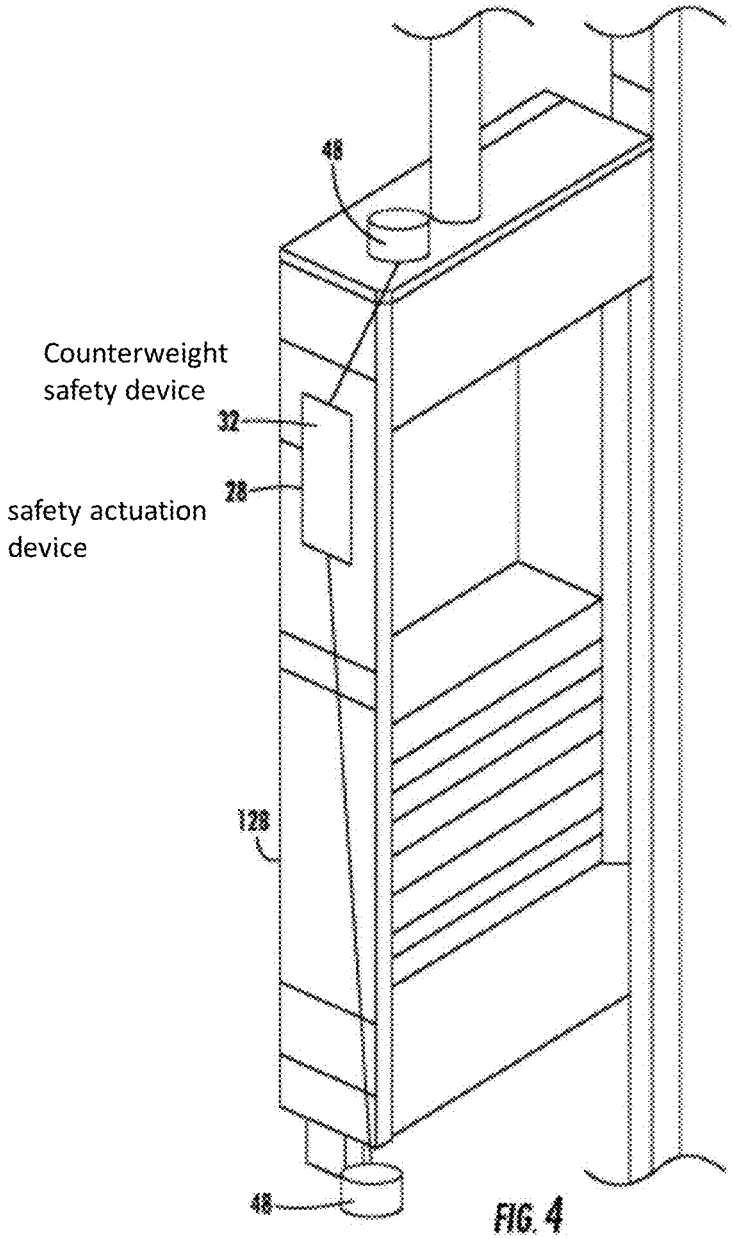
FIG. 4 is a perspective view of an electronic safety actuation device with a power assembly in use with an elevator counterweight.

The first power storage device 42 is operably coupled to a power generating component 48 (shown in FIGS. 3 and 4). The power generating component 48 is configured to generate power when the elevator car 12A and counterweight 12B are in motion. In an embodiment, the power generating component 48 includes a wind turbine disposed within the hoistway 14. In this embodiment, power is generated from the wind created as the elevator car 12A and counterweight 12B travels up and down the hoistway 14. Power may then be transferred from the power generating component 48 to the first power storage device 42.

It will be appreciated that the power generating component 48 may be disposed in any location within the hoistway 14. In one embodiment, as shown in FIG. 3, the power generating component 48 and the power assembly (not shown) are located on the elevator car 12A and may provide power to components on the elevator car 12A. In one embodiment, as shown in FIG. 4, the power generating component 48 and the power assembly (not shown) are located on the counterweight 12B and may provide power to components on the counterweight 12B. In one embodiment, there may be a plurality of power generating component 48 operably coupled to the first power storage device 42 to provide power thereto.

Figure 5:
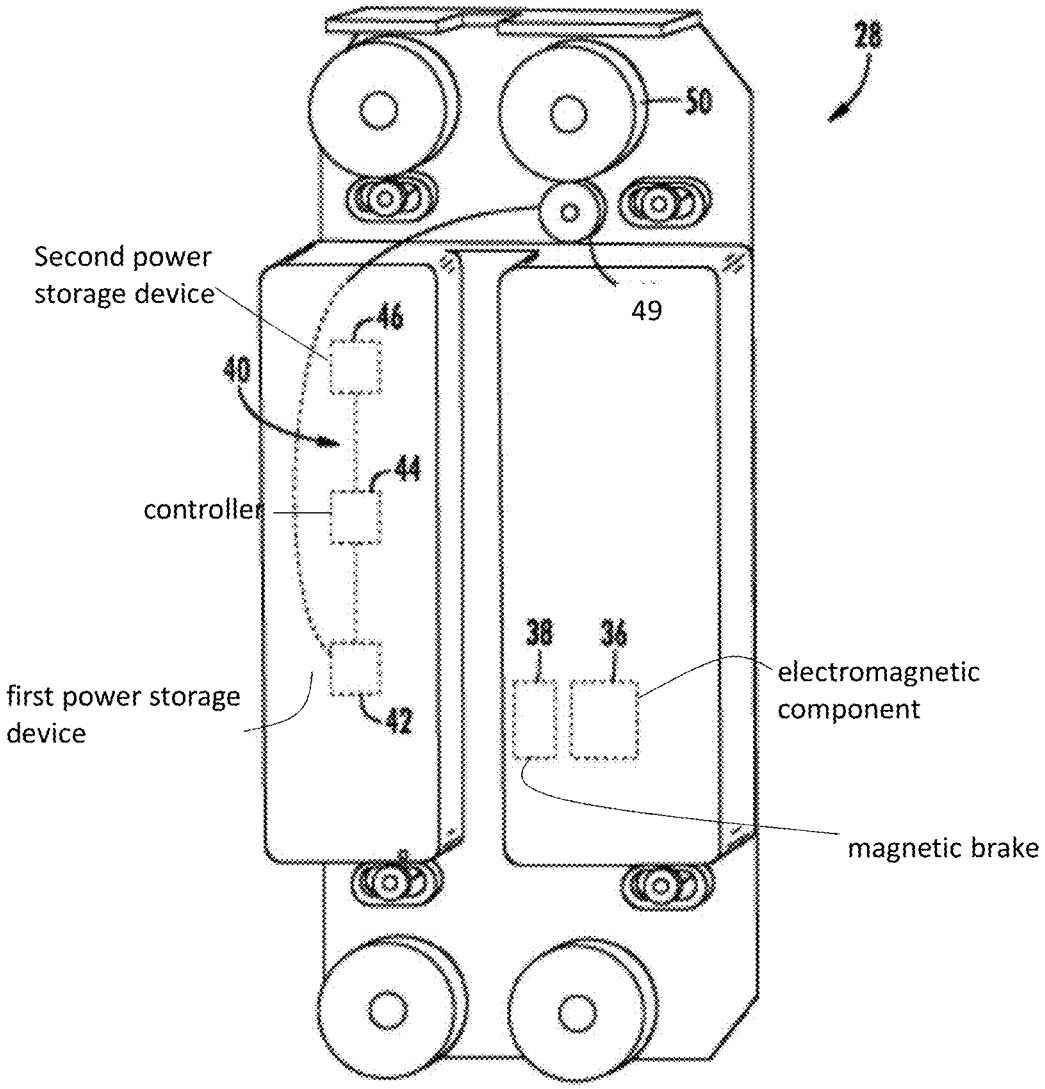
FIG. 5 is a perspective view of an electronic safety actuation device with a power assembly in use without a power traveling cable.

In one embodiment, as shown in FIG. 5, the power generating component 48 may be disposed directly on the safety actuation device 28. For example, the safety actuation device 28 may include roller guides 50 to enable travel along the car guide rails 18 and/or counterweight guide rails 20. The power generating component 49 may be in contact with the roller guide 50 such that rotation of the roller guide 50 causes rotation of the power generating component 48.

As the power generating component 48 rotates, electrical power is created. Power may then be transferred from the power generating component 48 to the first power storage device 42. Either of the aforementioned arrangements, therefore, eliminates the need for a travelling cable to power the safety actuation device 28.

In one embodiment, the power generating component 48 may be located anywhere on the elevator car 12A and/or counterweight 12B and have a dedicated roller guide 50 that engages with the car guide rail 18 or counterweight guide rail 20, respectively. In one embodiment, the power generating component 48 may be located anywhere on the elevator car 12A and/or counterweight 12B and use a pre-existing or multipurpose rollers that engages with the car guide rail 18 or counterweight guide rail 20, respectively.

Returning to FIG. 2, during typical operation, the electromagnetic component 36 is a keeper configured to hold the magnetic brake 38 in a non-engaging position without power needed. The magnetic brake 38 provides a sufficient magnetic attraction force in a direction toward the electromagnetic component 36 to hold the magnetic brake 38 in the non-engaging position.

During an over-speed or other condition requiring braking, the elevator drive 34 may wirelessly transmit a safety signal to the electronic safety actuation device controller 44 to actuate the electromagnetic component 36. In one embodiment, the electronic safety actuation device controller 44 may itself sense the over-speed or other condition requiring braking and actuate the electromagnetic component 36. Upon receipt of the safety signal, the electronic safety actuation device controller 44 may issue an actuation command to the electromagnetic component 36 to propel the magnetic brake 38 towards the car guide rail 18 and/or counterweight guide rail 20 into an engaging position by using the power from the second power storage device 46.

In the rail-engaging position, illustrated in FIG. 2, the exemplary magnetic brake 38 is magnetically attached to the car guide rail 18. The magnetic brake 38 is operably coupled to a safety brake 52 by a rod or small linkage bar 54. The magnetic brake 38, in the rail-engaging position, pushes/pulls the safety brake 52 in an upward direction due to the relative upward movement of the magnetic brake 38 relative to the descending elevator car 12A. The safety brake 52 engages the car guide rail 18 when the magnetic brake 38 pushes/pulls the safety brake 52 in the upward direction. A wedge-shaped portion 56 of the safety brake 52 allows a safety brake pad 58 to move toward and engage with the car guide rail 18 upon upward movement of the magnetic brake 38 and the rod 54.

It will therefore be appreciated that the present elevator system 10 includes an safety actuation device 28 that may be powered by a self-sustaining power assembly, including a power generating component 48, without the need of additional traveling cables for power; thus, decreasing the costs of material and installation time of the elevator system 10.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. An elevator system comprising:

a hoistway;

an elevator component disposed in the hoistway; and a power generating device disposed within the hoistway and operably coupled to the elevator component, wherein the power generating device is configured to generate power when the elevator component is in motion;

a magnetic brake disposed adjacent to an electromagnetic component, the magnetic brake configured to move between an engaging position and a non-engaging position;

a power assembly including:

at least one power storage device operably coupled to the power generating device; and a safety actuation device controller operably coupled to the at least one power storage device, the safety actuation device controller configured to receive and transmit safety signals;

wherein, upon receipt of the safety signal, the safety actuation device controller issues an actuation command to the electromagnetic component to propel the magnetic brake towards at least one of a car guide rail and a counterweight guide rail into an engaging position using power from the at least one power storage device.

2. The elevator system of claim 1, wherein the elevator component comprises at least one of an elevator car and a counterweight.

3. The elevator system of claim 1, wherein the power generating device comprises a wind turbine.

4. The elevator system of claim 1, wherein the safety actuation device comprises a roller guide affixed thereto.

5. The elevator system of claim 4, wherein the power generating device is disposed adjacent to and in contact with the roller guide.

6. The elevator system of claim 1, further comprising an elevator drive, wherein the elevator drive is operably coupled to the elevator component and in communication with the safety actuation device controller to receive and transmit the safety signals.

7. The elevator system of claim 6, wherein the safety actuation device controller is configured to wirelessly exchange safety signals with the elevator drive.

8. A safety actuation assembly comprising:

a housing;

a power assembly disposed within the housing;

an electromagnetic component operably coupled to the housing, the electromagnetic component operably coupled to the power assembly, wherein the electromagnetic component is configured generate an actuation or reset;

a power generating device operably coupled to the power assembly, the power generating device configured to transfer power to the power assembly based in part on movement of the power generating device;

a magnetic brake disposed adjacent to the electromagnetic component, the magnetic brake configured to move between an engaging position and a non-engaging position based in part on a holding force;

wherein the power assembly comprises:

at least one power storage device operably coupled to the power generating device; and a safety actuation device controller operably coupled to the at least one power storage device, the safety actuation device controller configured to receive and transmit safety signals;

wherein, upon receipt of the safety signal, the safety actuation device controller issues an actuation command to the electromagnetic component to propel the magnetic brake towards at least one of a car guide rail and a counterweight guide rail into an engaging position using power from the at least one power storage device.

9. The safety actuation assembly of claim 8, wherein the safety controller comprises a communication module.

10. The safety actuation assembly of claim 9, wherein the communication module is configured to wirelessly receive and transmit safety signals.

11. The safety actuation assembly of claim 8, wherein the power generating device comprises a wind turbine.

12. The safety actuation assembly of claim 8, further comprising a roller guide affixed to the housing.

13. The safety actuation assembly of claim 12, wherein the power generating device is disposed adjacent to and in contact with the roller guide.

* * * * *